US009057268B2

(12) United States Patent
Lindsey

(10) Patent No.: US 9,057,268 B2
(45) Date of Patent: Jun. 16, 2015

(54) ROTARY PISTON AND CYLINDER DEVICES

(75) Inventor: Stephen Francis Lindsey, Richmond (GB)

(73) Assignee: Lontra Limited, Warwickshire (GB)

( * ) Notice: Subject to any disclaimer, the term of this patent is extended or adjusted under 35 U.S.C. 154(b) by 1439 days.

(21) Appl. No.: 12/279,426

(22) PCT Filed: Feb. 16, 2007

(86) PCT No.: PCT/GB2007/000562
§ 371 (c)(1),
(2), (4) Date: Dec. 30, 2008

(87) PCT Pub. No.: WO2007/093818
PCT Pub. Date: Aug. 23, 2007

(65) Prior Publication Data

US 2009/0120406 A1 May 14, 2009

(30) Foreign Application Priority Data

Feb. 16, 2006 (GB) ..... 0603099.3

(51) Int. Cl.
*F02B 53/04* (2006.01)
*F01C 1/00* (2006.01)
(Continued)

(52) U.S. Cl.
CPC ..... *F01C 11/004* (2013.01); *F01C 3/02* (2013.01); *F01C 20/12* (2013.01); *F01C 21/006* (2013.01); *F01C 21/06* (2013.01); *F03C 2/00* (2013.01); *F01C 21/18* (2013.01)

(58) Field of Classification Search
CPC ..... F01C 11/004; F01C 20/12; F01C 21/18; F01C 21/06; F01C 21/006; F03C 2/00
USPC ..... 123/221–229, 248, 43 A, 240, 245; 418/35–38, 160, 161, 173, 175, 176, 418/177, 184, 186, 196, 144
See application file for complete search history.

(56) References Cited

U.S. PATENT DOCUMENTS 967,396 A * 8/1910 Lecaime ..... 418/176
1,330,257 A * 2/1920 Gillespie ..... 123/229
(Continued)

FOREIGN PATENT DOCUMENTS

DE 819 606 9/1951
DE 2262131 A1 * 6/1974 ..... F01C 11/00
(Continued)

OTHER PUBLICATIONS

Non-Final Office Action, dated Jul. 26, 2011, pp. 1-7, Japan Patent Application No. 2008554851, filed Aug. 13, 2008, Tokyo, Japan.
(Continued)

*Primary Examiner* — Thai Ba Trieu
(74) *Attorney, Agent, or Firm* — Brinks Gilson & Lione

(57) ABSTRACT

A rotary piston and cylinder assembly having two rotary piston and cylinder devices, each device including a rotor and a stator, the stator at least partially defining an annular cylinder space, the rotor being in the form of a ring, and the rotor having at least one piston which extends from the rotor ring into the annular cylinder space. In use the at least one piston is moved circumferentially through the annular cylinder space on rotation of the rotor relative to the stator, the rotor body being sealed relative to the stator, and the device further having cylinder space shutter means which is capable of being moved relative to the stator to a closed position in which the shutter means partitions the annular cylinder space, and to an open position in which the shutter means permits passage of the at least one piston, the cylinder space shutter means including a shutter disc, wherein the devices are connected by a transfer passage.

25 Claims, 16 Drawing Sheets

(51) Int. Cl.

| | |
|---|---|
| ***F03C 2/00*** | (2006.01) |
| ***F01C 11/00*** | (2006.01) |
| ***F01C 3/02*** | (2006.01) |
| ***F01C 20/12*** | (2006.01) |
| ***F01C 21/00*** | (2006.01) |
| ***F01C 21/06*** | (2006.01) |
| ***F01C 21/18*** | (2006.01) |

(56) References Cited

U.S. PATENT DOCUMENTS

| | | | | | |
|---|---|---|---|---|---|
| 1,363,256 | A | * | 12/1920 | Luebeck | 123/230 |
| 2,067,728 | A | * | 1/1937 | Plato | 418/186 |
| 2,170,366 | A | * | 8/1939 | Dominguez | 123/228 |
| 2,627,161 | A | | 2/1953 | Lindhagen et al. | |
| 2,760,466 | A | * | 8/1956 | Black, Jr | 123/203 |
| 3,053,438 | A | * | 9/1962 | Meyer | 418/235 |
| 3,165,093 | A | * | 1/1965 | Etxegoien | 123/240 |
| 3,682,143 | A | * | 8/1972 | Leas | 123/240 |
| 3,762,167 | A | * | 10/1973 | Wahnschaffe et al. | 60/519 |
| 3,763,649 | A | * | 10/1973 | Wahnschaffe et al. | 60/519 |
| 3,884,664 | A | * | 5/1975 | Edwards | 418/181 |
| 3,976,037 | A | * | 8/1976 | Hojnowski | 123/240 |
| 3,986,483 | A | * | 10/1976 | Larson | 418/176 |
| 4,013,046 | A | | 3/1977 | Kemp | 123/8.27 |
| 4,015,441 | A | * | 4/1977 | Robinet | 418/13 |
| 4,033,300 | A | * | 7/1977 | Larson | 418/176 |
| 4,138,847 | A | * | 2/1979 | Hill | 60/519 |
| 4,519,206 | A | * | 5/1985 | van Michaels | 123/204 |
| 5,073,097 | A | * | 12/1991 | Pipalov | 418/177 |
| 5,083,539 | A | * | 1/1992 | Cornelio | 123/210 |
| 5,375,985 | A | * | 12/1994 | Pipaloff | 418/177 |
| 5,537,974 | A | | 7/1996 | Palmer | 123/204 |
| 5,597,295 | A | * | 1/1997 | Pipaloff | 418/177 |
| 5,803,041 | A | * | 9/1998 | Motakef | 418/176 |
| 5,855,474 | A | * | 1/1999 | Shouman | 418/13 |
| 5,992,560 | A | * | 11/1999 | Matsuoka et al. | 181/252 |
| 6,336,317 | B1 | | 1/2002 | Holtzapple et al. | 60/39.63 |
| 7,281,606 | B2 | * | 10/2007 | Marocco | 181/270 |
| 7,305,963 | B2 | * | 12/2007 | Zak | 123/228 |
| 7,341,041 | B2 | | 3/2008 | Pekau | 123/206 |
| 8,602,757 | B2 | * | 12/2013 | Patterson | 418/144 |
| 2004/0050618 | A1 | * | 3/2004 | Marocco | 181/248 |
| 2005/0279571 | A1 | * | 12/2005 | Marocco | 181/270 |
| 2007/0175435 | A1 | | 8/2007 | See | 123/229 |
| 2013/0156564 | A1 | * | 6/2013 | Dong et al. | 415/196 |

FOREIGN PATENT DOCUMENTS

| | | | | | |
|---|---|---|---|---|---|
| DE | 3306256 | A1 | * | 8/1984 | F01C 11/00 |
| EP | 0 933 500 | A1 | | 8/1999 | F01C 3/02 |
| GB | 07516 | A | | 6/1911 | |
| GB | 874045 | A | | 4/1959 | |
| GB | 2 233 041 | A | | 1/1991 | |
| GB | 2 402 974 | A | | 12/2004 | F04C 3/02 |
| JP | 56020702 | A | | 2/1981 | F02B 53/00 |
| JP | S57-26204 | | | 2/1982 | |
| JP | 3-96683 | | | 4/1991 | |
| JP | S57-044790 | | | 3/1992 | |
| JP | 10196384 | A | * | 7/1998 | |
| JP | 2004-50422 | | | 2/2004 | |
| JP | 2004-527682 | | | 9/2004 | |
| WO | WO 02/070878 | A1 | | 9/2002 | |
| WO | WO 2006/042423 | A1 | | 4/2006 | F01C 3/02 |

OTHER PUBLICATIONS

Final Office Action, dated Apr. 3, 2012, pp. 1-6, Japan Application No. 2008554851, filed Aug. 13, 2008, Japan Patent Office, Tokyo, Japan.

* cited by examiner

ROTARY PISTON AND CYLINDER DEVICES

BACKGROUND AND SUMMARY

This invention relates to rotary piston and cylinder devices which may be, for example, in the form of an internal combustion engine, or a pump such as a supercharger or fluid pump, or as an expander such as a steam engine or turbine replacement.

The term 'piston' is used herein in its widest sense to include, where the context admits, a partition capable of moving relative to a cylinder wall, and such partition need not generally be of substantial thickness in the direction of relative movement but can often be in the form of a blade. The partition may be of substantial thickness or may be hollow.

The invention relates in particular to a rotary piston and cylinder devices of the type comprising a rotor and a stator, the stator at least partially defining an annular cylinder space, the rotor is in the form of a ring, and the rotor comprising at least one piston which extends from the rotor ring into the annular cylinder space, in use the at least one piston is moved circumferentially through the annular cylinder space on rotation of the rotor relative to the stator, the rotor body being sealed relative to the stator, and the device further comprising cylinder space shutter means which is capable of being moved relative to the stator to a closed position in which the shutter means partitions the annular cylinder space, and to an open position in which the shutter means permits passage of the at least one piston, the cylinder space shutter means comprising a shutter disc.

In a highly preferred embodiment the at least one piston extends generally inwardly from the rotor ring and the stator is positioned generally internally of the ring.

The stator may have portions which extend generally radially outwardly beyond the ring if desired.

Preferably the shutter disc presents a partition which extends substantially radially of the annular cylinder space.

Although in theory the shutter means could be reciprocable, it is much preferred to avoid the use of reciprocating components, particularly when high speeds are required, and the shutter means is preferably at least one rotary shutter disc provided with at least one aperture which in the open condition of the shutter means is arranged to be positioned substantially in register with the circumferentially-extending bore of the annular cylinder space to permit passage of the at least one piston through the shutter disc.

Preferably the at least one aperture is provided radially in the shutter disc.

Preferably the rotor is adapted to receive the shutter disc.

The shutter disc is preferably driven from the rotor through a suitable transmission means.

Preferably the axis of rotation of the rotor is not parallel to the axis of rotation of the shutter disc. Most preferably the axis of rotation of the rotor is substantially orthogonal to the axis of rotation of the shutter disc.

Preferably the piston is so shaped that it will pass through an aperture in the moving shutter means, without balking, as the aperture passes through the annular cylinder space. The piston is preferably shaped so that there is minimal clearance between the piston and the aperture in the shutter means, such that a seal is formed as the piston passes through the aperture. A seal is preferably provided on a leading or trailing surface or edge of the piston. In the case of a compressor a seal could be provided on a leading surface and in the case of an expander a seal could be provided on a trailing surface.

The rotor body is preferably rotatably supported by the stator rather than relying on co-operation between the pistons and the cylinder walls to relatively position the rotor body and stator.

It will be appreciated that this is distinct from a conventional reciprocating piston device in which the piston is maintained coaxial with the cylinder by suitable piston rings which give rise to relatively high friction forces.

The rotor ring is preferably rotatably supported by suitable bearing means carried by the stator.

Preferably the stator comprises at least one inlet port and at least one outlet port.

Preferably at least one of the ports is substantially adjacent to the shutter means.

Preferably the ratio of the angular velocity of the rotor to the angular velocity of the shutter disc is 1:1.

Multiple connected devices (whether in the form of compressors, expanders or other form) may be joined to one or more common intake outlet manifolds. This may be to so that a more continuous flow of gas is input or outputted (as the multiple devices may have different intake phases etc.). An example is a supercharger or compressor where two or more devices may be joined to a common output manifold to produce a nearly continuous output flow.

According to one aspect of the invention there is provided a rotary piston and cylinder assembly comprising two rotary piston and cylinder devices, and a transfer conduit, the transfer conduit fluidically connecting an outlet port of one device to an inlet port of the other device.

According to one aspect of the invention there is provided a rotary piston and cylinder assembly comprising two rotary piston and cylinder devices of the type set forth, a transfer conduit which connects an output port of one device to an input port of the other device, and the assembly further comprising heat transfer means for bringing exhaust fluid of the other device into thermal communication with fluid in the transfer conduit.

According to another aspect of the invention there is provided a rotary piston cylinder assembly comprising two rotary piston and cylinder devices of the type set forth, a transfer conduit which connects an output port of one device to an input port of the other device, and the assembly further comprising means for conveying exhaust fluid of the other device into the transfer conduit.

According to a further aspect of the invention there is provided a rotary piston and cylinder assembly comprising two rotary piston and cylinder devices of the type set forth and a transfer conduit that connects an output port of one device with an input port of the other device, wherein the transfer passage is provided with turbulence generating means which, in use, causes turbulent flow of fluid passing through the transfer passage.

According to another aspect of the invention there is provided a rotary piston and cylinder device comprising two rotary piston and cylinder devices of the type set forth and a transfer conduit which connects an output port of one device with an input port of the other device, the transfer conduit being provided with resonance control means which, in use, is operative to damp or amplify fluid pressure waves of fluid in the transfer conduit.

According to another aspect of the invention there is provided a rotary piston and cylinder device comprising two rotary piston and cylinder devices of the type set forth and a transfer conduit which connects an output part of one device with an input port of the other device, the transfer conduit being provided with compressed gas storage means, which in use, is operative to supply compressed gas into the transfer conduit.

According to a further aspect of the invention there is provided a rotary piston and cylinder device of the type set forth comprising an adjustable port arrangement, the adjustable port arrangement comprising a displaceable stator wall portion which is adapted to be movable relative to an aperture region provided in the stator which aperture region provides fluid communication between the cylinder space and a region external of the device, and the arrangement being such that the stator wall portion can be moved so as to alter the position and/or extent of the aperture relative to the annular cylinder space.

According to yet a further aspect of the invention there is provided a rotary piston and cylinder device of the type set forth in which the rotor is provided with an aperture region, and the stator is provided with an aperture region, at least one of the rotor and the stator being provided with a movable portion and when in communication, the aperture regions provide fluid communication between the annular cylinder space and a region external of the device, the arrangement of the device being such that, in use, the movable portion can be moved and so the angular extent of at least one of the aperture regions can be altered.

Another aspect of the invention relates to a rotary piston and cylinder assembly comprising two rotary piston and cylinder devices of the type set forth and a transfer conduit which connects an output port of one device with an input port of the other device, the transfer conduit being provided with acoustically absorbent means.

According to another aspect of the invention there is provided a rotary piston and cylinder device of the type set forth comprising an adjustable port arrangement, the adjustable port arrangement comprising a displaceable portion which is adapted to be moveable relative to an aperture region provided in the rotor, which aperture region provides fluid communication between the cylinder space and a region external of the cylinder space, and the arrangement being such that the displaceable portion can be moved so as to alter the position and/or extent of the aperture region relative to the cylinder space.

Yet a further aspect of the invention concerns an internal combustion engine comprising two piston and cylinder devices of the type set forth, a transfer conduit which connects an output port of one device to an input port of the other device and fuel injection means, the fuel injection means being arranged to issue fuel into the transfer conduit.

BRIEF DESCRIPTION OF THE DRAWINGS

Various embodiments of the invention will now be described, by way of example only, with reference to the accompanying drawings in which.

DESCRIPTION OF PREFERRED EMBODIMENTS

Figure 1:
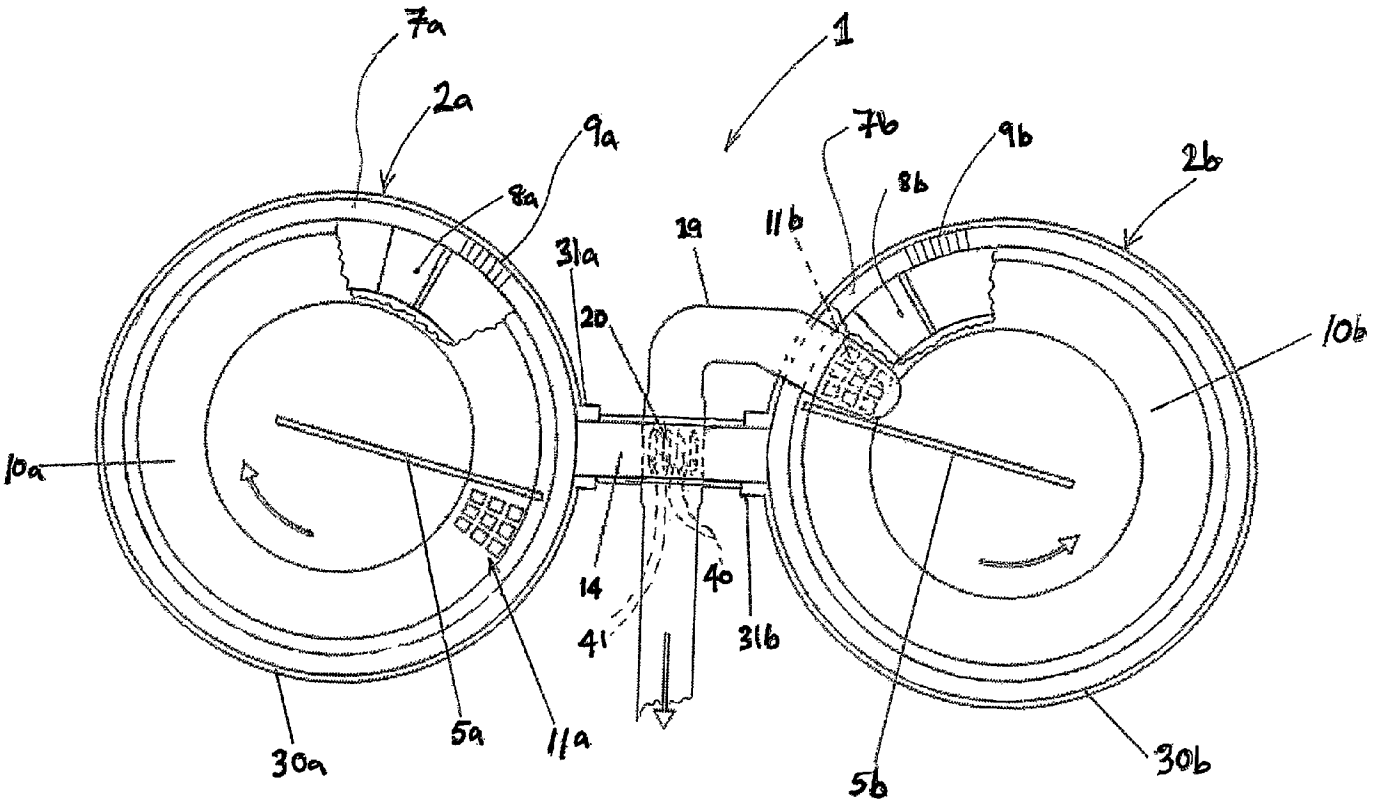
FIG. 1 is a side elevation of a first rotary piston and cylinder assembly.

FIG. 1 shows a rotary piston and cylinder assembly 1 forming a combustion engine. The assembly 1 comprises two piston and cylinder devices 2*a* and 2*b* which are connected by a transfer passage 14. The engine may be considered as two conjoined positive displacement pumps, with one chamber providing induction and compression and the other combustion and exhaust. This separation of cycles allows for their optimisation without compromise, and significant benefits are achieved. The transfer passage 14 may be of construction or material such as ceramic to thermally insulate the devices 2*a* and 2*b* from one another to some extent. Since one of the options is to run the two devices at different temperatures. The engine combines the advantages of both a turbine and a reciprocating engine. It allows efficient operation over a wide range of speeds and conditions while at the same time all motions are purely rotary and the intake and exhaust are continually open as in a turbine engine.

FIGS. 2*a*, 2*b*, 2*c* and 2*d* show the principal components of each of the piston and cylinder devices 2*a* and 2*b*.

Figure 2A:
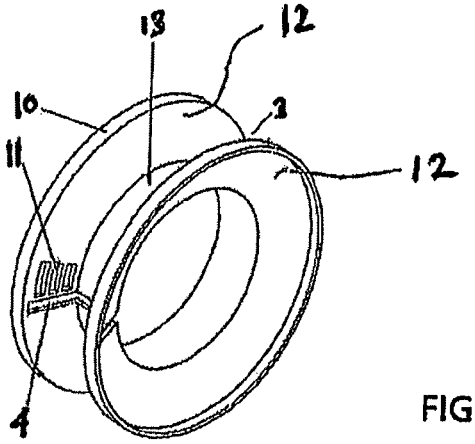
FIGS. 2*a*, 2*b*, 2*c* and 2*d* are perspective views of each principal component of each rotary piston and cylinder device of the assembly of FIG. 1.

FIG. 2*a* shows a stator 10 which is provided with a port 11 in the side wall 12 and the two side walls 12 and base 13 defining an annular cylinder space 3. The stator 10 has a radial slot 4 which is dimensioned to receive a shutter disc 5 whose purpose is to partition the annular cylinder space 3.

Figure 2B:
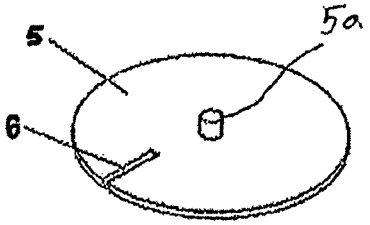

FIG. 2*b* shows the shutter disc 5 which fits into the slot 4 in the stator 10 and partitions the annular cylinder space 3. The shutter disc 5 is provided with a slot 6 to allow a suitably shaped piston 8 to pass therethrough.

Figure 2C:
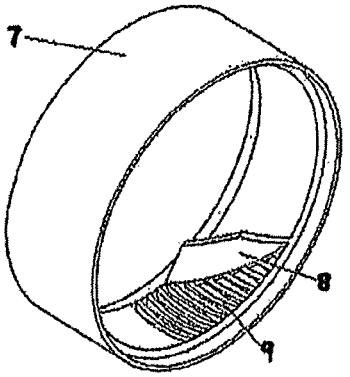

FIG. 2*c* shows a rotor ring 7 and extending inwardly thereof is attached the piston 8. The ring 7 fits around the outside of the stator 10 to enclose the annular cylinder space 3. The ring 7 and the piston 8 rotate around the stator 10 on suitable bearings (not shown) provided on the stator 10. The ring 7 is provided with a grilled port 9 which is adjacent to the piston 8.

The width of each of the openings forming the grilled port 9 in the direction of the rotor is less than the thickness of the shutter disc 5. The shutter disc may incorporate an extension on its edge to increase its thickness.

Figure 2D:
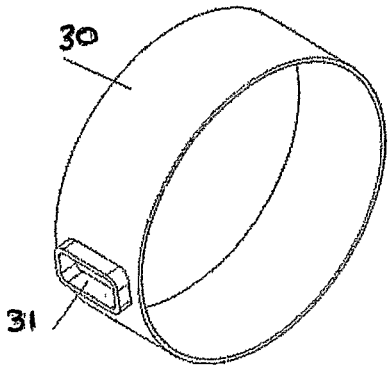

FIG. 2*d* shows a static outer housing 30 which fits around the outside of the rotor ring 7 and is provided with a port 31. The combined action of the port 9 in the rotor ring 7 and the port 31 in the static outer housing forms a valve, which, is in an open condition when the two parts are aligned (or at least in fluid communication) and closed when they are not.

Rotation transmission means (not shown) rotationally connects axle 4 of the shutter disc 5 to the rotor ring 7 to ensure a suitable relative speed so that the piston 8 can pass through the slot 6 without balking.

Returning to FIG. 1 the transfer passage 14 connects the outlet port 31*a* of the compressor device 2*a* and to the inlet port 31*b* of the expander device 2*b*.

The port 11*a* in the side wall of the stator 10*a* on the device 2*b* forms the intake port through which fresh charge is drawn.

The port 11*b* in the side wall of the stator 10*b* of the expander device 2*b* forms an exhaust port through which spent charge is exhausted.

Forming an engine by conjoining a compressor device and an expander device in this way allows the compression cycle and the expansion cycle to be optimised independently. For example the compressor device 2*a* can be run at a different temperature to the expander, the compressor device 2*a* may use different sealing or different lubrication strategies to the expander, and/or the compression ratio of the device 2*a* and the expansion ratio of the device 2*b* can be different.

The engine assembly 1 can be configured so that the transfer occurs at constant volume or alternatively the gas can continue to be compressed during transfer (possibly a small amount to make up for any leakage) or even expanded.

Exhaust gas from the expander device 2*b* can be transferred from the exhaust port 11*b* through a manifold 19 to a heat exchanger 20. The heat exchanger 20 extends through the transfer passage 14. More particularly the heat exchanger 20 comprises a plurality of relatively narrow conduits 40 which are spaced by gaps 41. The gaps 41 allow the fluid in the transfer passage to pass therethrough and accordingly enhance the heat transfer to said fluid.

The heat exchanger 20 exchanges heat between the exhaust gas from the expander device 2*b* and the gas in the transfer passage 14 which is yet to enter the expander device 2*b*.

Importantly the heat exchanger 20 does not allow the exhaust gas therein to mix with the gas in the transfer passage 14.

The transfer of heat from the hot exhaust gas to the transfer passage gas allows some of the energy to be recovered, and so increases the overall efficiency of the engine assembly 1. In addition such heat recycling could be used to 'tune' the engine temperature and so reduce the warm-up time of the expander device 2*b*.

This heat recycling does not affect the volumetric efficiency of the compressor device 2*a* because the intake air to the compressor device 2*a* remains unheated.

In use of the engine assembly I the compressor device 2*a*, draws fluid through the open port 11*a* as the piston 8*a* and rotor ring 7*a* rotate. At the same time as inducing air behind the piston 8*a*, fluid induced in the last complete rotation of the rotor ring 7*a* is compressed in front of the piston 8*a* against the shutter disc 5*a*.

As the port 9*a* in the rotor ring 7*a* and the port 31*a* in the static outer housing 30*a* come into register, the valve so formed opens and the compressed fluid is discharged into the transfer passage 14.

In the expander device 2*b*, pressurised fluid enters the cylinder space of the device through the port 31*b* in the outer housing 30*b* and the port 9*b* in the rotor ring 7*b*. As the rotor ring 7*b* rotates, the valve closes and the pressurised fluid is expanded. Ignition means (not shown), such as a spark plug provided in the stator 10*b*, then ignites the fuel mixture.

After further rotation the port 11*b* allows the remaining gas to escape into the manifold 19. Further remaining fluid is forced through the port 11*b* during the next expansion cycle.

It will be appreciated that a rotational output of the ring 7*b* drives both the shutter disc 5*b* and, by way of suitable rotational transmission means (not shown) the rotor ring 7*a* and the shutter disc 5*a* of the compressor device 2*a*.

In an alternative embodiment a heat exchanger is not provided and exhaust gas from the expander device is merely channelled away from the transfer passage towards an exhaust manifold (not shown).

Figure 3:
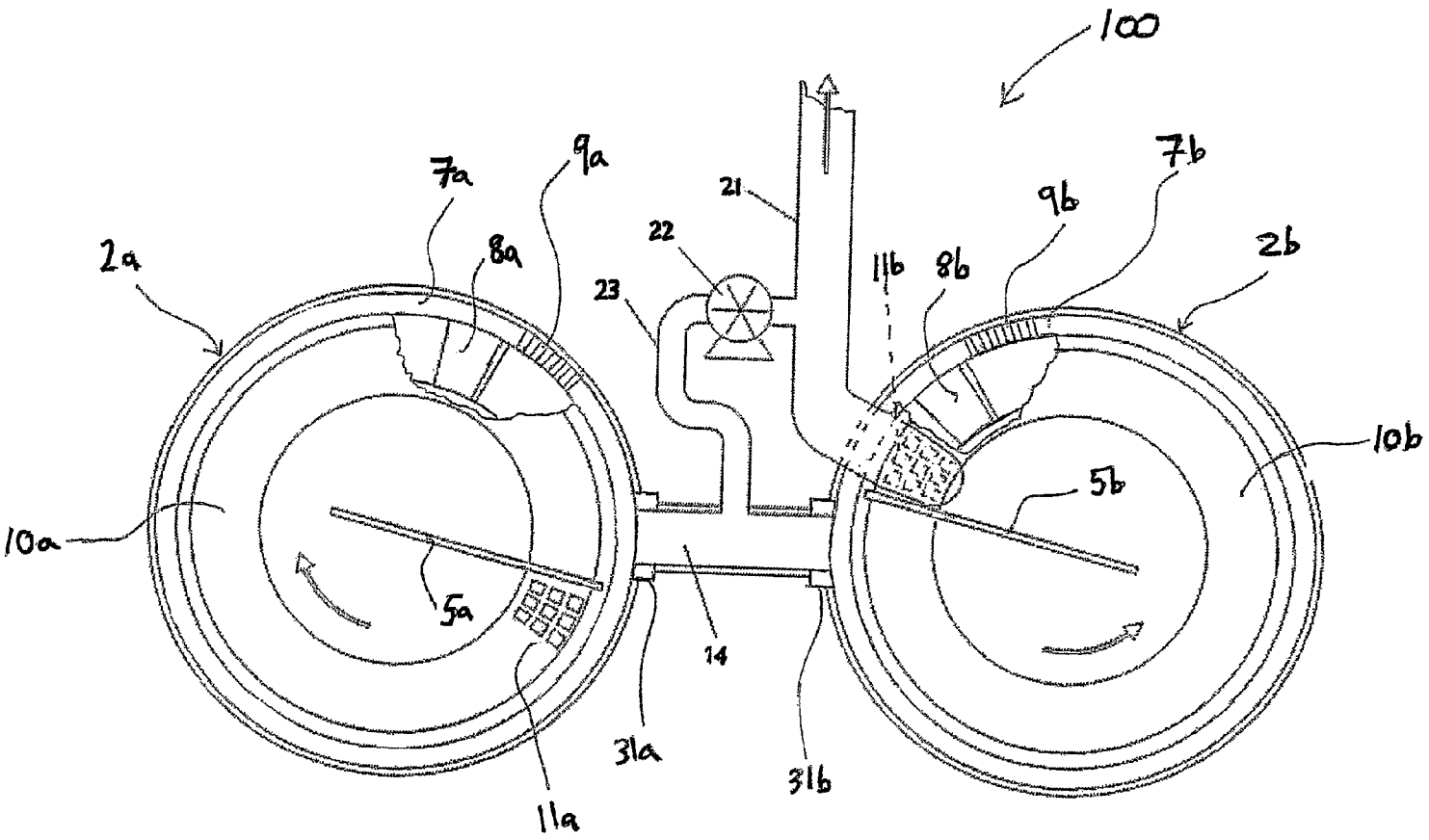
FIG. 3 is a side elevation of a second rotary piston and cylinder assembly.

FIG. 3 shows device 2*a* of an internal combustion engine 100, in which like reference numerals indicate like features and wherein a proportion of exhaust gas is re-circulated to the transfer passage 14. A route for exhaust gas to pass from exhaust manifold 21 back to the transfer passage 14 is provided by an additional manifold 23. A pump 22 is operative to control the flow of exhaust gas between the exhaust manifold 21 and the transfer passage 14. It will be appreciated that further valves, pumps or other fluid control means may be employed to control this flow.

This exhaust gas recirculation may be used to control combustion or burn rate. It may also be used to control the temperature in the expander device 2*b*. Further it may be used to control emissions or to help control a controlled auto-ignition (CAI) cycle. These are just some of the reasons that exhaust gas recirculation into the transfer passage 14 may be used. Recirculation in this way does not affect the volumetric efficiency of the compressor device 2*a*.

Figure 20:
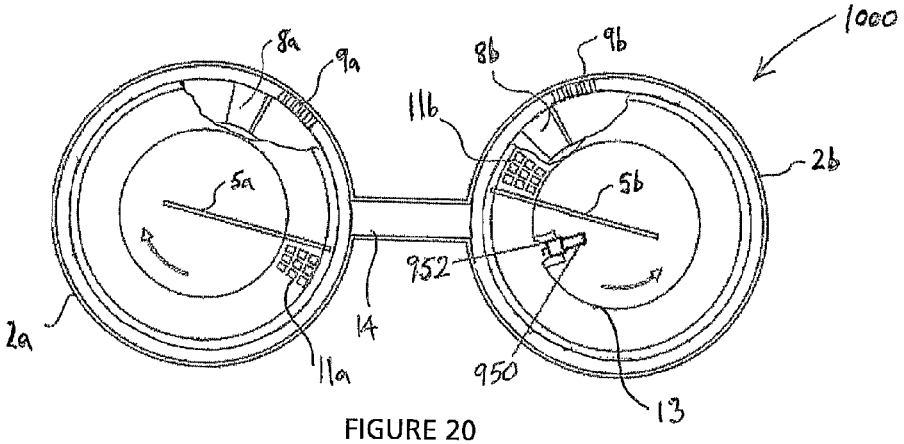
FIG. 20 is a side elevation of a combustion engine with ignition means in a first location.

Attention is now given to the location of ignition means in an expander device of an engine. With reference to FIG. 20 there is shown a combustion engine 1000 comprising two conjoined rotary piston and cylinder devices 2*a* and 2*b*. The expander device 2*b* is provided with a spark plug 950. Specifically the electrodes of the spark plug 950 are located in a recess or nacelle 952 of the base 13 of the stator.

Figure 21:
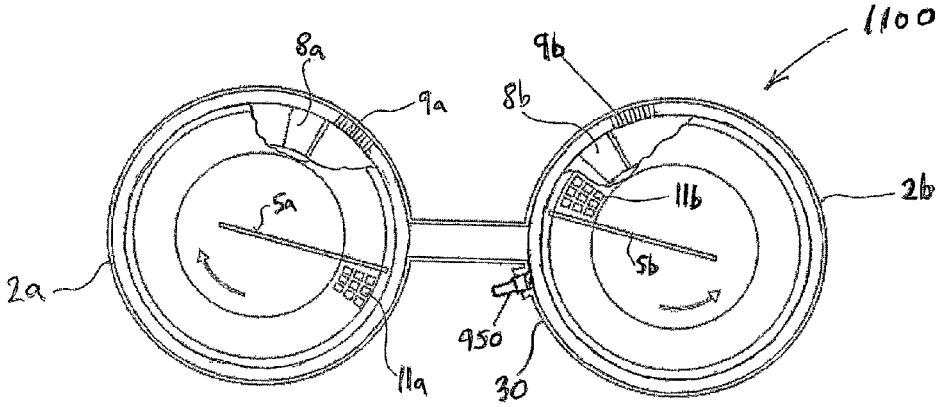
FIG. 21 is a side elevation of a combustion engine with ignition means in a second location.

FIG. 21 shows a combustion engine 1100 in which the spark plug 950 is located in a recess of the outer housing 30 of the expander device 2*b*. Accordingly the working fluid in the chamber is only exposed to the electrodes of the spark plug when the intake port 9*b* is in register with the spark plug. Advantageously since the spark plug is only exposed to the hot combustion mixture for a short time the lifetime of the spark plug should be improved. In one embodiment a glow plug may be provided in place of a spark plug and the ignition timing being provided by the interaction of the glow plug with the intake port 9*b*.

Figure 22:
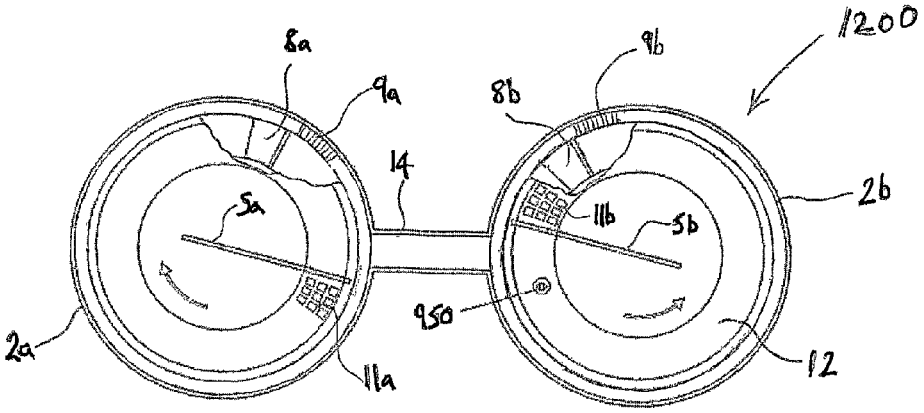
FIG. 22 is a side elevation of a combustion engine with ignition means in a third location.

FIG. 22 shows a combustion engine 1200 in which a spark plug 950 is provided in a recess of a side wall 12 of the stator.

Figure 4:
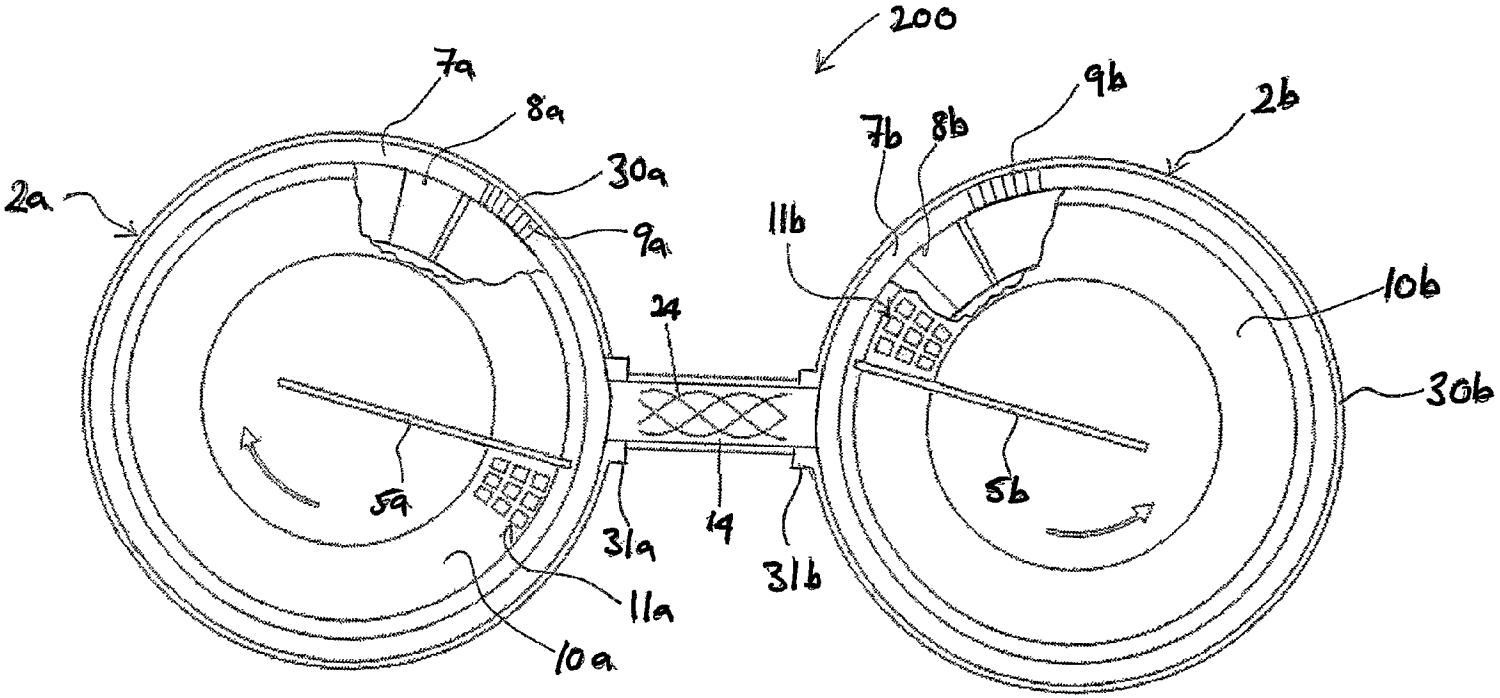
FIG. 4 is a side elevation of a third rotary piston and cylinder assembly.

FIG. 4 shows an internal combustion engine 200 which includes an arrangement 24 which is adapted, in use, to modify the flow of gas within the transfer passage 14 so as to encourage turbulent fluid flow in the passage. The arrangement 24 may be realised in numerous ways and may be static, movable and/or powered. The arrangement (shown schematically at 24) may comprise a flap or flaps extendible into the transfer passage space or a number of other features or shapes having surface portions on which the gas impacts in order to modify the fluid flow characteristics thereof. The arrangement 24 may be described as an aerodynamic device. The turbulence created in the transfer passage may comprise one or a combination of a swirling motion and/or a tumbling motion.

The arrangement 24 may be deformable such that its configuration presented to the fluid changes as the rate of fluid flow through the passage 14 and on to the device changes. The arrangement 24 may be dynamically controllable (in real time) by way of user controllable motive means or settable at the time of manufacture (to account for different fuels etc). Accordingly the position, shape, configuration and/or orientation may be set or dynamically controlled.

The amount of turbulence generated may be modified to control the mixing of fluids in the transfer passage 14 so as to control the mixing of fuel and air in the transfer passage 14 or to affect conditions later in the cycle, in the expander device 2*b* (which is downstream of the arrangement 24).

Alternatively the turbulence generated could be used to control the mixing of the transfer passage fluid and any recirculated exhaust fluid, either within the transfer passage or downstream of the arrangement 24 in the expander device 2*b*.

The control of turbulence could be used to allow the heat transfer rate between a heat exchanger (such as heat exchanger 20) and the gas in the transfer passage 14 to be controlled.

Importantly, the degree of turbulence of fluid in the transfer passage 14 controls at least in part the combustion in the expander device 2*b* and so appropriate control of the turbulence could be used to maximise the efficiency of combustion. The optimum amount of turbulence varies for different engine operating speeds, different engine loads and different fuels.

A particular benefit of the location of the arrangement 24 in the transfer passage 14 is that the turbulence is generated just before the charge is combusted allowing for minimal energy loss (to effects such as viscous flow) from the fluid. This is in contrast to a traditional reciprocating engine in which turbulence is generated by the flow of gas through the intake valves and then must go through a compression cycle before combustion (giving more time for a loss of turbulence energy).

Figure 14:
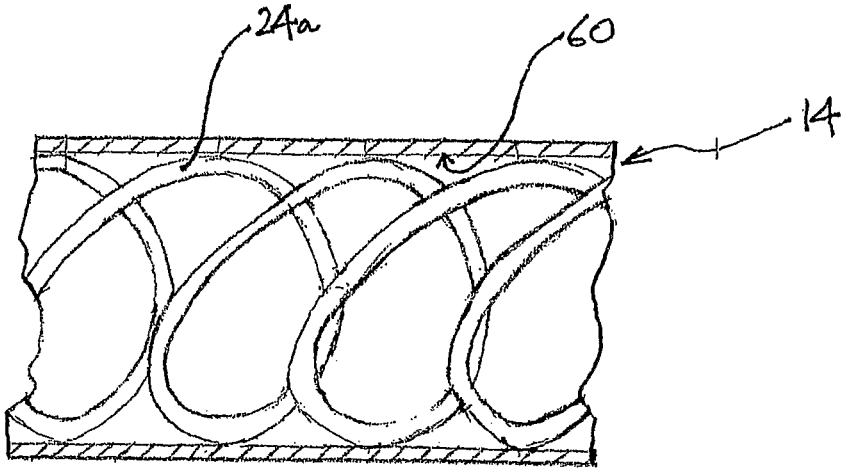
FIG. 14 shows a schematic representation of an embodiment turbulence generating means.

A turbulence generating arrangement 24*a* is shown in FIG. 14, and comprises a vane of substantially helical form which extends radially inwardly from inner wall 60 of the transfer passage 14.

Figure 15:
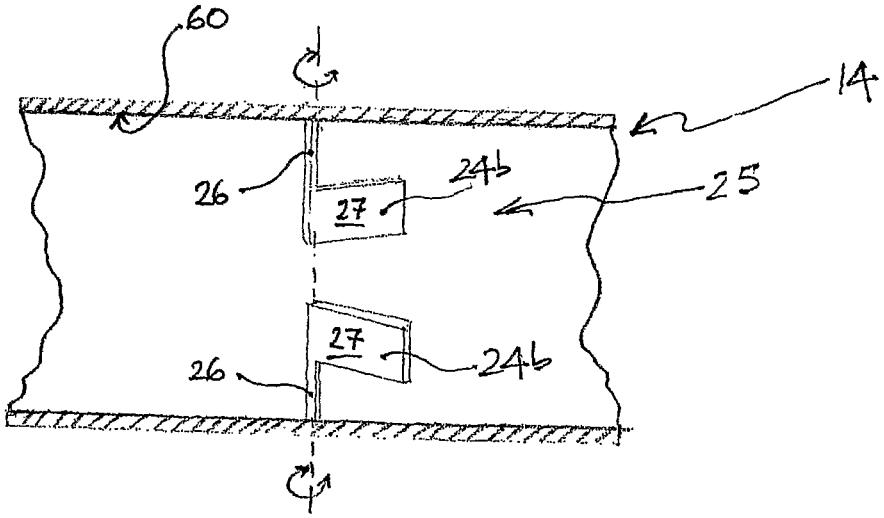
FIG. 15 shows a schematic representation of a further embodiment of a turbulence generating means.

A further turbulence generating arrangement 24*b* is shown in FIG. 15 which comprises two rotatably mounted flap devices 25. Each flap device 25 comprises a stem 26 which is torsionally flexible (as indicated by the double-headed arrows) and the stem is connected to a flap portion 27. The arrangement is such that in use at low fluid flow rates each flap device would present a large surface to the fluid and so increased turbulence is generated. However, if the fluid rate increased then the stems 26 would be caused to flex and so the surface area presented to the fluid flow would decrease. In yet a further alternative 'passive' arrangement a stem of a rotatably mounted flap device is engageable with resilient biasing means (for example a spring) wherein the flap device is biased towards presenting a higher surface area to the fluid flow. In an alternative embodiment the stems 26 are of substantially rigid construction and each flap portion is of a sufficiently flexible construction to provide flexure in response to variations in the fluid flow rate.

In an alternative arrangement each of the flap devices is connected to motive means (not shown) which means is operative to control the inclination of each device relative to the direction of fluid flow in the transfer passage. In the above described flap device embodiments, although two flap devices are described, one or more such devices may be implemented.

Figure 5:
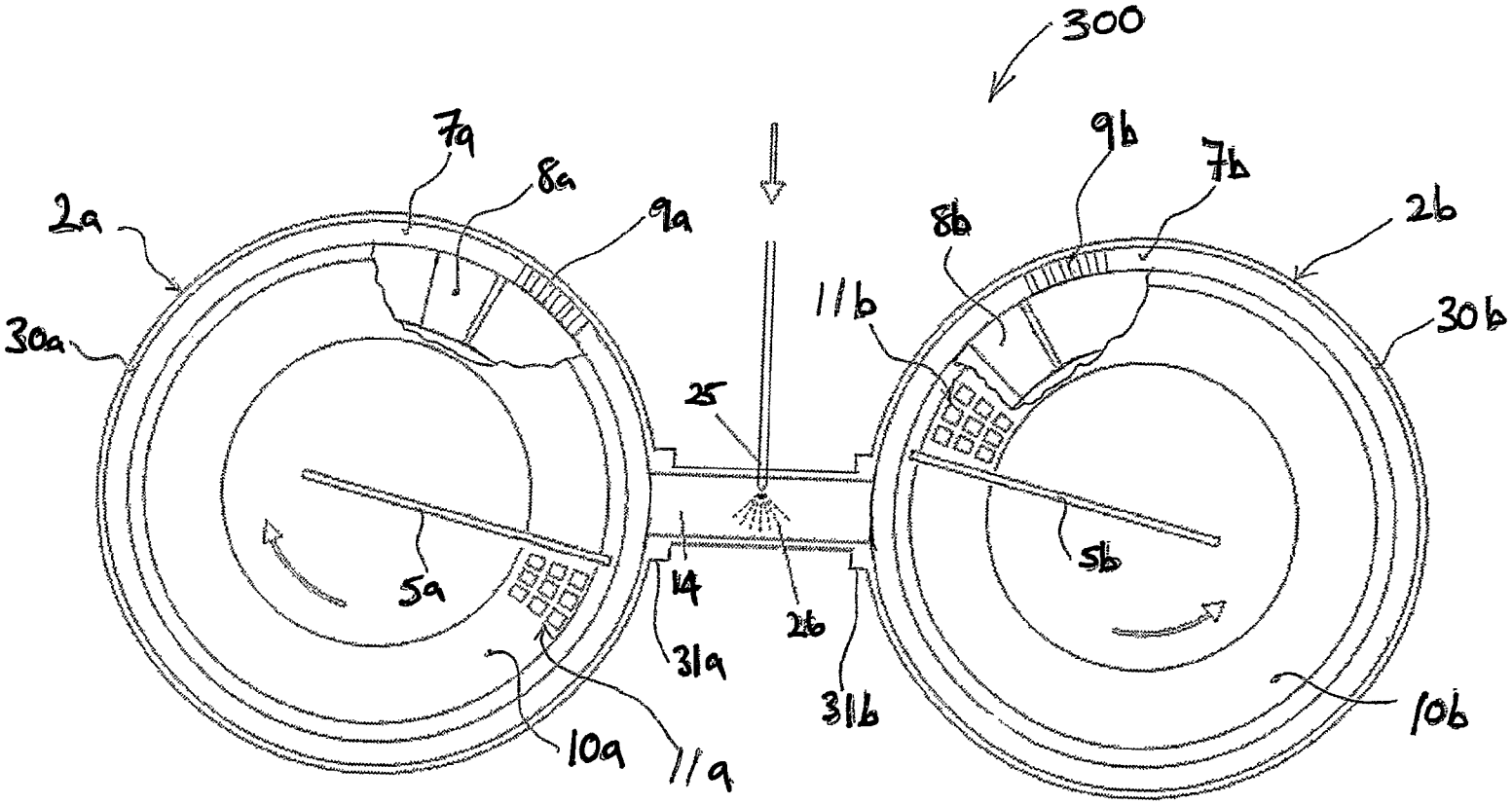
FIG. 5 is a side elevation of a fourth rotary piston and cylinder assembly.

FIG. 5 shows an internal combustion engine 300 in which a fuel injector 25 injects fuel 26 directly into the transfer passage 14. Alternatively or in addition, however, the fuel may be injected into the compressor intake port 4*a*, into the compressor intake manifold, into the annular cylinder space itself or into the expander chamber.

Injection into the transfer passage 14 has the benefit not reducing the volumetric efficiency of the compressor device 2*a*.

Injecting into the transfer passage 14 also means that there is no fuel in the compressor 2*a* to wet the walls thereof, which would affect lubricants or damage coatings. Advantageously the absence of fuel in the compressor device 2*a* allows optimisation of the materials of construction thereof.

Further injection of fuel into the transfer passage 14 may allow further control of charge stratification (by injecting more fuel into some of the charge passing through the transfer passage than other). This has the benefit in controlling combustion.

Multiple injectors may be used, as may multiple transfer passage manifolds.

Figure 6:
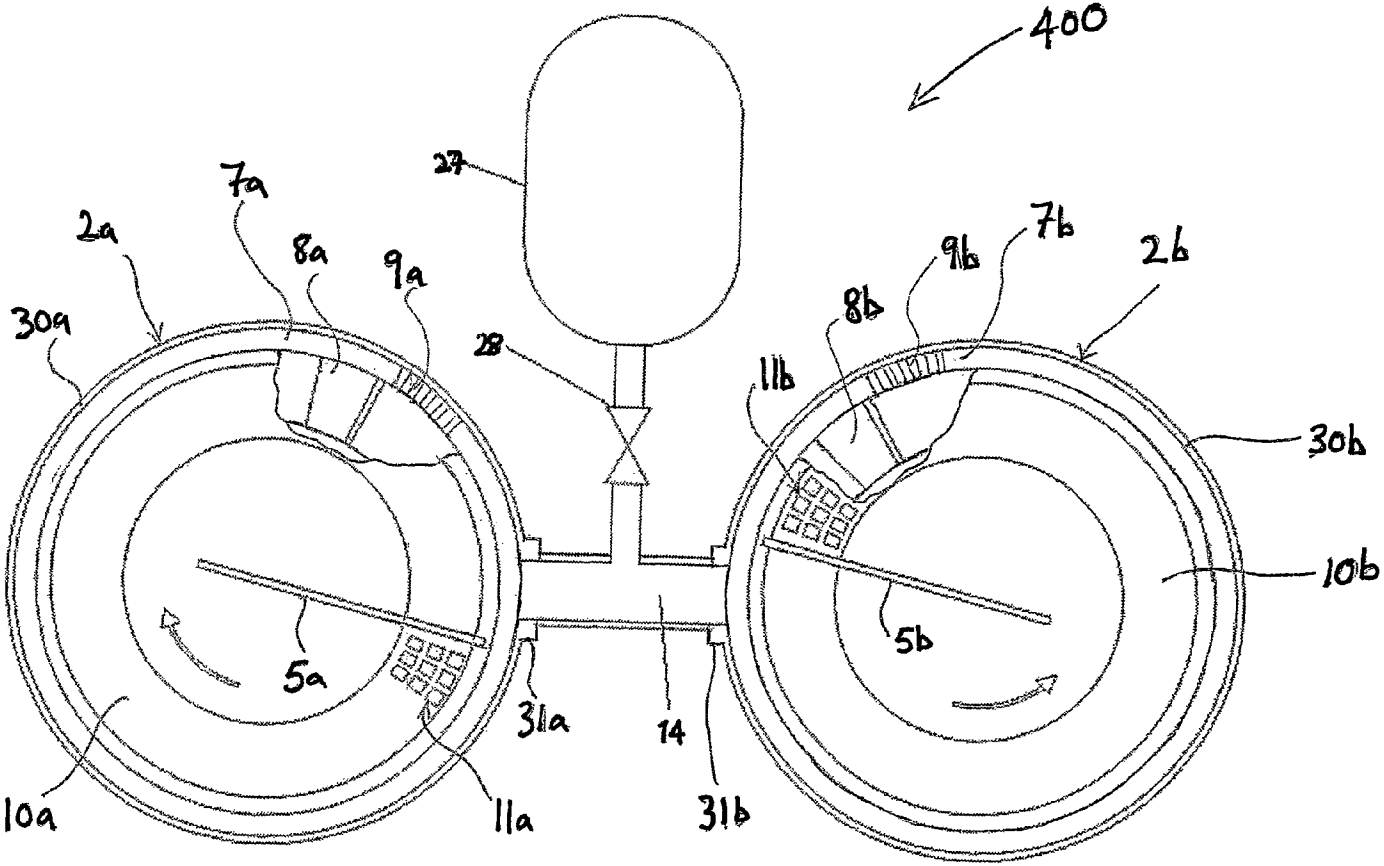
FIG. 6 is a side elevation of a fifth rotary and piston cylinder assembly.

FIG. 6 shows an internal combustion engine 400 comprising a receptacle/storage tank 27 which is attached to the transfer passage 14 by valve means 28 which allows compressed fluid to be stored between cycles.

In use, during a braking cycle of the engine, the valve 28 would allow the compressed gas to be stored in the receptacle 27. Then, when re-accelerating, a variable intake port (not shown) or other suitable means could reduce the pressure attained in the compressor device 2*a* reducing the compression work required. Gas would be allowed to re-enter the transfer passage 14 from the receptacle 27 to make up the pressure difference (as if the variable port had not been used to reduce the compression ratio). Overall this would advantageously allow an increase in efficiency as the energy from engine braking would be re-captured and this forms a type of 'weak' hybrid. This is just one example of the use of the receptacle 27 and the valve means 28. In addition or alternatively, compressed gas captured during the engine braking cycle could be used for one or more devices, either attached to the engine 400 or otherwise, for example a pneumatic braking system.

The valve means 28 may be operatively connected to control means such that compressed gas received from the device 2*a* (when the valve means 28 is opened) could be released from the tank 27 towards the device 2*b* in subsequent cycles of the device 2*a* so performing gas storage and gas release steps.

In an alternative embodiment a chamber 29 may be in the form of an expansion chamber, wherein at a specific frequency a sudden change in cross-sectional area of the chamber 29 is brought about so as to reflect waves towards the transfer passage.

It is possible that the engine 400 could be powered purely on compressed gas from the receptacle 27 in some instances with power derived from expanding the compressed air in the expander device 2*b*. This would require either bypassing the compressor stage or using variable porting (as hereinafter described) to reduce the compression ratio.

In yet another alternative embodiment the receptacle 27 is in the form of a source of compressed gas which gas is not provided from the compressor device 2*a*. In such an embodiment the valve 28 is a one-way valve allowing only gas to enter into the passage 14 and not vice versa.

Figure 7:
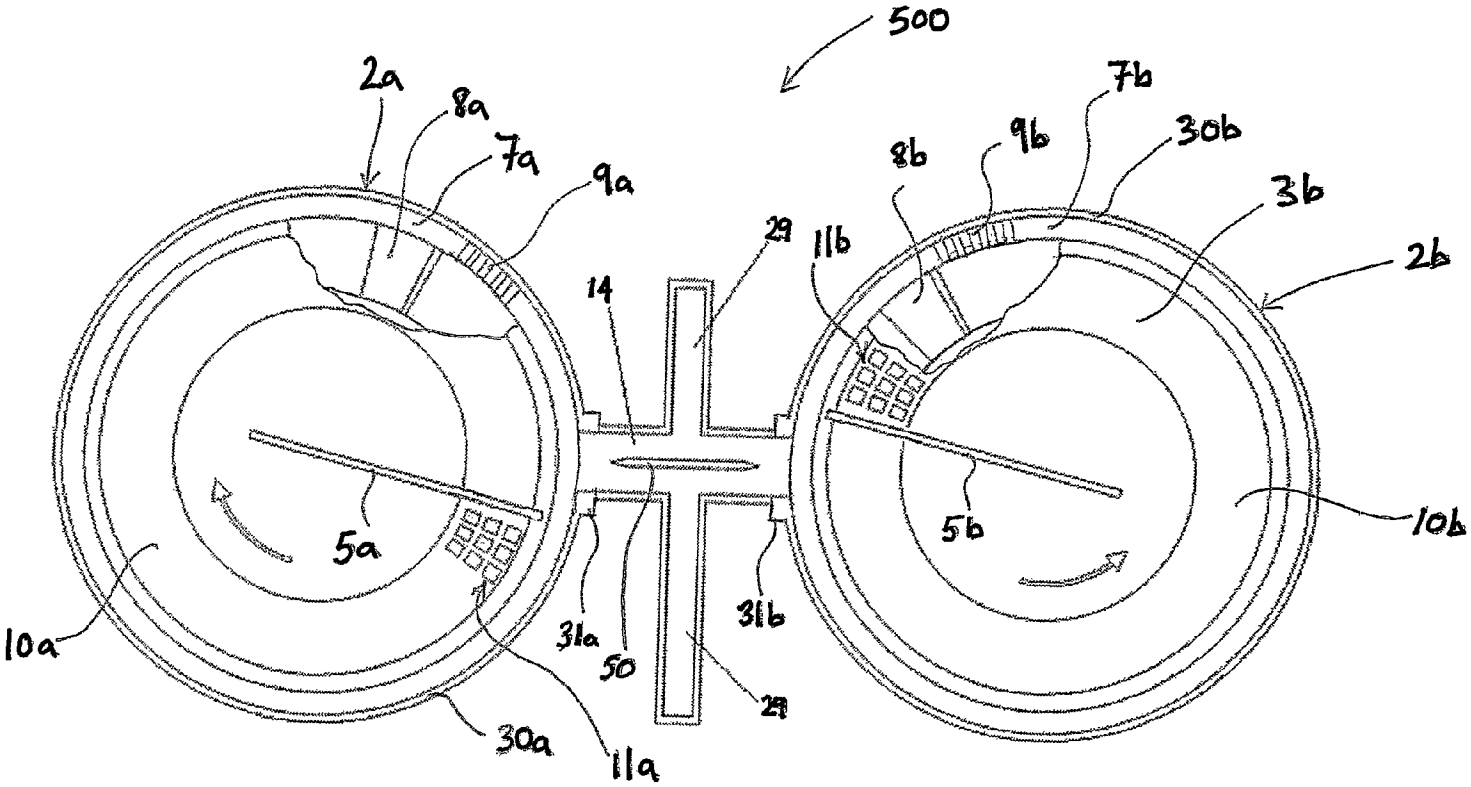
FIG. 7 is a side elevation of a sixth rotary piston and cylinder assembly.

FIG. 7 shows an internal combustion engine 500 comprising chambers 29 of substantially cylindrical shape which are attached to the transfer passage 14. These chambers allow the regulation of the resonance of the transfer passage and/or other parts of the engine caused by the interaction of pressure waves in the fluid which occurs as a result of the valves 31*a* and 31*b* being periodically opened and closed. Element 50 is a baffle/plate member which is operative to modify the effect of the resonant chamber.

Two chambers 29 are shown, however there may be one or multiple resonant chambers. Entry of fluid into one or more of the resonant chambers may be controlled by valves (not shown) which are selectively operable to isolate the chamber(s) from the transfer passage. In use, one or more resonant chambers act to damp the resonant effects of fluid in the transfer passage and so improve fluid flow and reduce noise. Various embodiments of chambers 29 may be envisaged. In one embodiment a chamber is in the form of a Helmholtz resonator-type arrangement, wherein at a specific frequency of pressure wave in the fluid the chamber resonates and waves are emitted towards and into fluid in the transfer passage so as to alternate resonance of pressure waves in the transfer passage. A further possibility is that a mechanism may be employed to allow the volume or length of the chamber(s) to be varied. One realisation of such an arrangement comprises a telescopic chamber. An alternative embodiment comprises a piston which is controllably moveable within a chamber. Further embodiments could be envisaged where multiple sub-chambers are fluidically connected by valves to allow the resonant volumes of the chambers to be modified. Such sub-chambers may be connected to the transfer passage so provide a return route thereto. In an embodiment the resonant chambers are adapted to amplify the resonant effect on the transfer passage such that, in use, constructive interference of pressure waves in the transfer passage is brought about.

In an alternative embodiment an acoustically absorbent material is provided in acoustic communication with the transfer passage such that, in use, pressure waves are dissipated as they pass through the transfer passage. In one realisation of such an embodiment the transfer passage is surrounded by acoustically absorbent material.

Although only one transfer passage is shown between the devices 2*a* and 2*b*, multiple transfer passages may be provided.

It will be appreciated that other embodiments of the invention comprise two rotary piston and cylinder devices 2*a* and 2*b*, a transfer passage therebetween and at least two of the heat exchanger arrangements of FIG. 1, the exhaust gas recirculation arrangement of FIG. 3, the turbulence generating arrangement of FIG. 4, the fuel injection arrangement of FIG. 5, the compressed fluid receptacle of FIG. 6 and the resonant chamber of FIG. 7.

Although in the above described embodiments the inlet and outlet ports of the devices 2, 2*a* and 2*b* are shown as being of fixed size, various further embodiments will now be described relating to control of port size using variable port arrangements.

Figure 8:
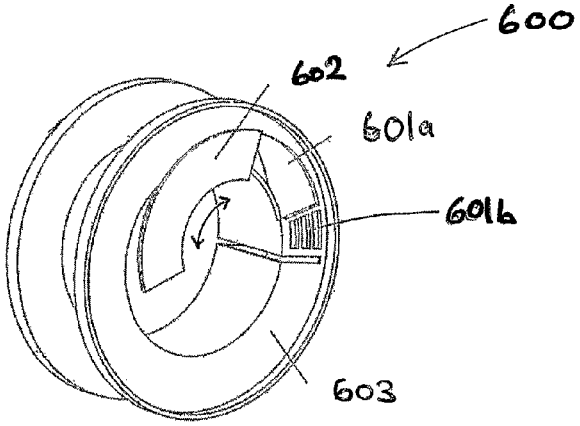
FIG. 8 is a perspective view of a first variable port arrangement.
Figure 8A:
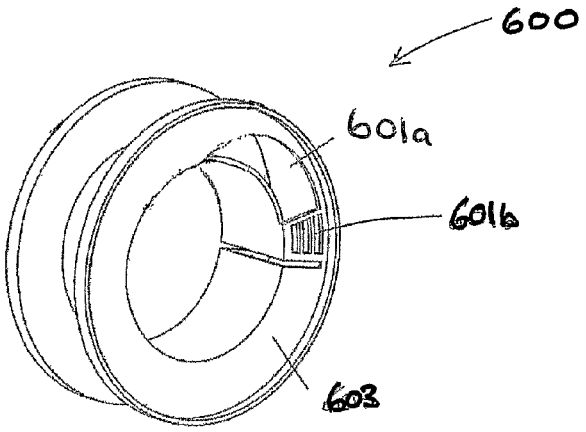
FIG. 8*a* is a perspective view of part of the first variable port arrangement shown in FIG. 8 in which a slidably mounted port cover has been removed.

With reference to FIG. 8 there is shown a stator assembly 600 of a rotary piston and cylinder device comprising a variable port arrangement. The arrangement comprises a slidable cover member 602 of substantially curved planar form which is adapted to slide in the arcuate aperture 601*a* provided in side wall 603. The surface of the cover member 602 that faces into the cylinder space is arranged to be substantially flush with adjacent inwardly facing surface portions of the side wall. Accordingly the cover member 602 is intended to 'replace' a side wall portion, at least from the piston's perspective such that no leakage path is created as the piston passes over the cover member. The side wall 603 in FIG. 8 may be substantially planar. This plane may be substantially radial to the disc axis or may be offset from a radius of the disc axis.

When discussing the angular extent of the ports, it is the axis about which the rotor ring 7 rotates and the axis around which the annular cylinder space 3 is formed which is referred to as a basis for determining angular coverage.

The slidable cover member 602 is adapted to be slid through an arc so as to selectively control the angular extent of the aperture 601*a*.

The stator assembly 600 is further provided with a second aperture 601*b*, the angular extent of which is not capable of being altered by movement of the slidable cover member 602.

The adjustability of the slidable cover member 602 relative to the aperture 601*a* allows the compression ratio to be altered. The point at which the compression stage starts is controlled in part by the angular position at which the piston 8 on the rotor ring 7 passes the end of the angular extent of the apertures 601*a* and 601*b*. If the angular extent of the aperture 601*a* port is increased, then the compression will start later in the rotation of the rotor ring. If all other parameters are the same this will lead to a reduction in the compression ratio. The volume of gas delivered from the outlet port of the device will remain the same if the timing of the interaction of the port provided in the rotor ring and the aperture provided in the outer housing from the outlet valve, remain the same.

With regard to FIG. 8 it will be appreciated that although the slidable cover member 602 is shown as being rotatable towards the centre of the device, in an alternative embodiment the cover member may be arranged to be rotatable outwardly of the device.

Control of the compression ratio in this way could be used in a compressor to control the outlet pressure in response to system demands.

Control of the port in this way in a supercharger embodiment would allow the mass flow of the supercharger to be varied without a variation in the supercharger rotational speed.

Control of the compression ratio in this way could be used to allow a form of engine throttling, reducing the power generated by the engine without the losses associated with a conventional throttle. A conventional throttle acts as a restriction in the intake of an engine, reducing the pressure downstream of it. The engine induces the same volume of air but at lower pressure, so that there is a net reduction in the number of air molecules and hence a reduction in the amount of fuel that can be burnt leading to a reduction in power. However, by using a controllable intake port (as formed by the slidable cover member 602 in combination with the aperture 601*a*) instead, increasing the angular extent of the aperture 601*a* effectively reduces the amount of air that is compressed, without a large reduction in the intake pressure. The overall effect is that fewer air molecules are delivered to the combustion chamber as with the conventional throttle, but importantly the pumping losses of the throttle restriction are avoided.

Similarly, modifying the exhaust port of the stator of an expander device (eg device 2*b*) allows the expansion ratio to be altered. The angular position at which the expansion within the chamber ends is controlled by the point at which the piston on the rotor ring passes the start of the exhaust port. If the angular extent of the exhaust port is increased, then the expansion will end earlier in the rotation of the rotor ring. If all other parameters are the same this will lead to a reduction in the expansion ratio. The volume of gas delivered through the inlet port of the device will remain the same if the timing of the interaction of the port provided in the rotor ring and the aperture provided in the outer housing that form the outlet valve and all other parameters, remain the same.

Reducing the expansion ratio in an engine could reduce the amount of work produced by the engine and increase the temperature of the exhaust. Where the engine is used as part of a Combined Heat and Power (CHP) apparatus, this would allow the heat to power ratio of the system to be controlled.

Temporarily increasing the exhaust energy by reducing an engine Embodiment's expansion ratio could be used to heat up a downstream catalyst more quickly. This could reduce 'light-off' emissions.

Temporarily increasing the exhaust energy by reducing the engine Embodiment's expansion ratio could be used to provide more energy for a downstream turbocharger to 'spool up', reducing 'lag' or the time that it takes to respond to a change in engine operating conditions.

Control of the expansion ratio in this way could be used in a single rotary piston and cylinder device forming an expander (such as a steam expander) to control the amount of work produced by the expander. It could also be used to control the outlet pressure of an expander.

These are only a few of the many possible advantages that could be gained from expansion ratio control.

Figure 9:
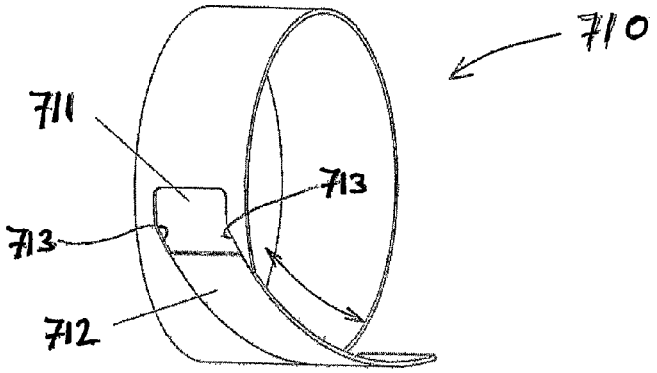
FIG. 9 is a perspective view of a second variable port arrangement.

With reference now to FIG. 9 there is shown a variable port arrangement provided in the outer housing of the stator of a rotary piston and cylinder device in which the port 711 is variably valved by a slidable member 712. The wall has formed therein a channel of substantially part helical form defined by wall portions 713. The slidable member 712 is intended to "replace" a portion of the outer housing, at least from the piston's perspective such that no leakage path is created as the piston passes over the slidable member. The aperture in the outer housing 711 and the port 9 in the rotor ring 710 forms a valve which is open when the port 9 and aperture 711 are substantially in register. The slidable member 712 allows the timing of this valve to be varied. The slidable member allows the angular extent of the aperture 711 to be controlled, in the same way as the variable aperture 601*a* in FIG. 8.

In an alternative embodiment a port is provided in the outer housing, and a curved slidable member is designed to move substantially circumferentially (ie substantially co-axially of the axis of the outer housing) around the cylinder space within the port (rather than helically or in part axially).

In a variant embodiment the port 711 is provided in the radially innermost base wall 13 of the stator of the rotary piston and cylinder device.

In a variant embodiment a port controlled by a slidable member is provided in the rotor ring 7 in addition to or replacing a port 9. This allows the timing of the valve formed by the interaction of the first mentioned port and an aperture in the outer housing to be adjusted.

In a compressor device the interaction of the port in the rotor ring and the port 711 can be used to control the compression ratio.

If the compression ratio is reduced in the compressor by increasing the inlet port angular extent (described above), the volume compressed is reduced and the volume delivered from the outlet port remains the same (if no other parameters are changed). If instead the compression ratio can be reduced by sliding the member 712 so as to increase the angular extent of the port 711 which may replace either the port 9 in the rotor ring 7 or the aperture 31 in the outer housing 30, the volume compressed remains the same, but the volume delivered from the outlet port is increased.

In one embodiment both the angular extent of the port 9 in the rotor ring 7 and the angular extent of the aperture 31 in the outer housing 30 may be variable.

If both the inlet port angular extent and the outlet valve timing (which timing is controlled by the angular extents of the port 9 and the aperture 31) can be varied, the compressed volume or mass flow and the compression ratio can be independently varied. For example if the angular extent of the inlet port is increased, the volume compressed is reduced. If the outlet valve timing remained the same, the compression ratio would be reduced, but if the extent of one or both of the ports forming the outlet valve is reduced, the compression ratio can be maintained. This means that the mass flow has decreased without a change in the compression ratio.

In an expander device, the inlet port is formed by the interaction of the port in the rotor ring and the port 711 and by sliding movement of the member 712 the angular extent of the port 711 can be used to control the expansion ratio. For example, the expansion ratio can be reduced by increasing the angular extent of the port 711, the volume expanded increases, but the volume delivered from the outlet port remains the same.

Figure 16:
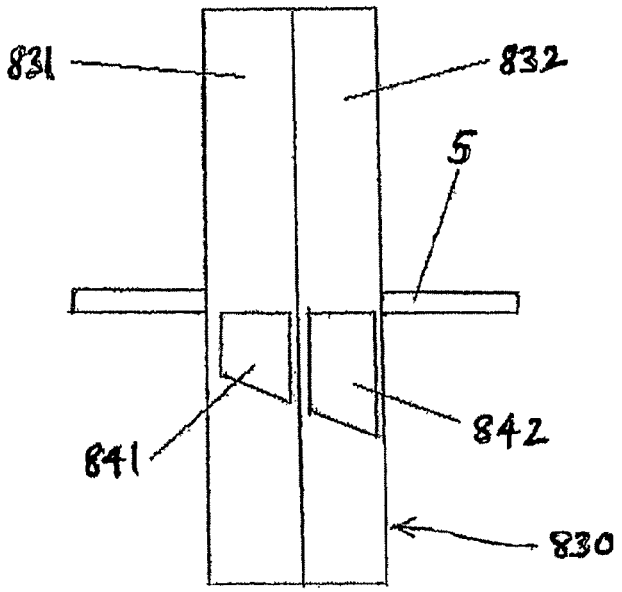
FIG. 16 is a schematic view of an outer housing of a rotary piston and cylinder device in a first condition.
Figure 17:
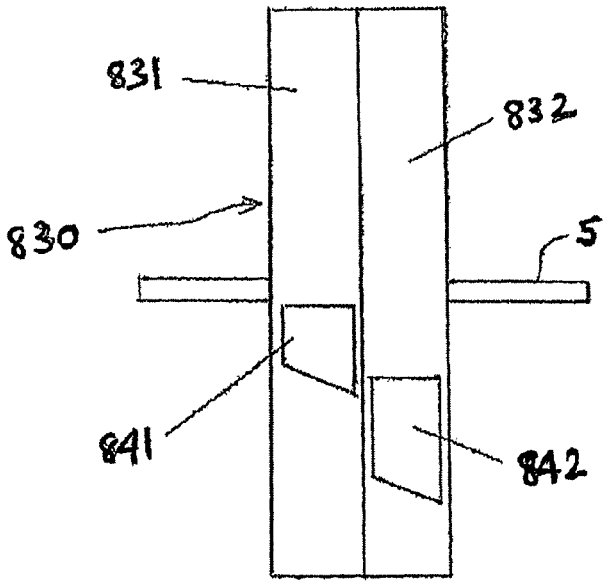
FIG. 17 is a schematic view of the outer housing of FIG. 16 in a second condition.

With reference to FIG. 16 there is shown an outer housing 830 of a rotary piston and cylinder device. The outer housing comprises two housing components 831 and 832, which are provided with apertures 841 and 842 respectively. The apertures 841 and 842 combine to serve as an input port for an expander device and an output port for a compressor device. The housing component 832 is mounted for rotational movement relative to the housing component 831. As shown in FIG. 17 the housing component 832 has been rotated relative to the housing component. In so doing the position of the aperture 842 has now changed relative to the aperture 841. Accordingly the timing of when an aperture of the rotor of the device comes into (at least partial) register with the other aperture (and in particular the aperture 842) is altered. It will be appreciated that more than two rotatable outer housing components could be provided, with each component being provided with one or more respective apertures.

Figure 18:
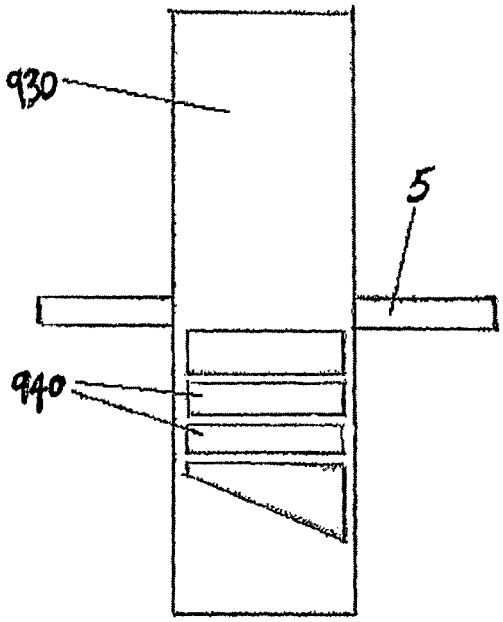
FIG. 18 is a schematic view of outer housing of a rotary piston and cylinder device in a first condition.

FIG. 18 shows an outer housing 930 of a rotary piston and cylinder device. The outer housing 930 comprises multiple aperture regions 940 which together form an output port. The outer housing 930 is mounted for rotation relative to the cylinder space.

Figure 19:
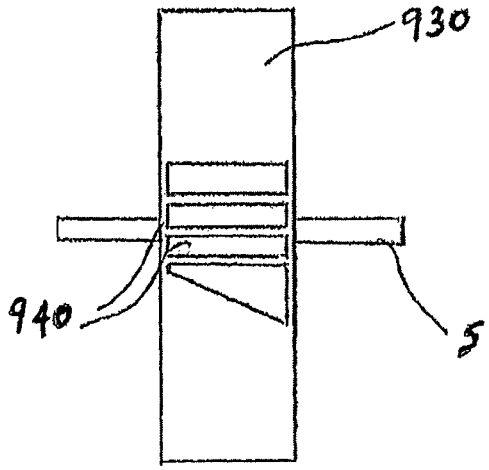
FIG. 19 is a schematic view of outer housing of a rotary piston and cylinder device in a second condition.

FIG. 19 shows the outer housing 930 in an adjusted position in which the timing of the aperture of the rotor comes into register with the aperture regions 940 is altered (as compared to that for the position shown in FIG. 18).

Figure 10:
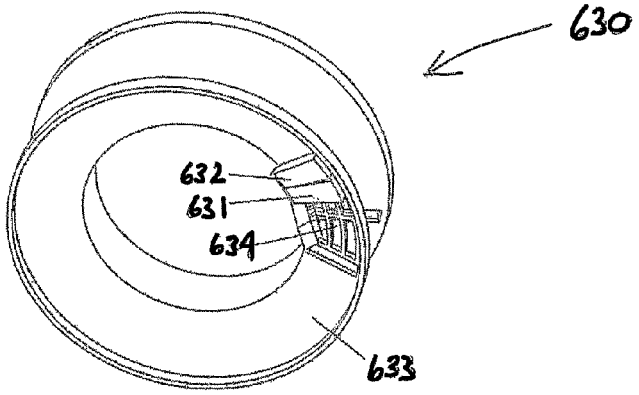
FIG. 10 is another perspective view of a third variable port arrangement.

In FIG. 10, a stator 630 comprising an alternative variable port arrangement is shown. The arrangement comprises a sidewall 633 having two removable plug elements 631 and 632 which can be secured to or moved from the stator and so vary the angular extent of the port 634. The elements can be selectively moved to form a continuous port or alternatively can be arranged to be separated such that multiple ports may be opened.

Figure 11:
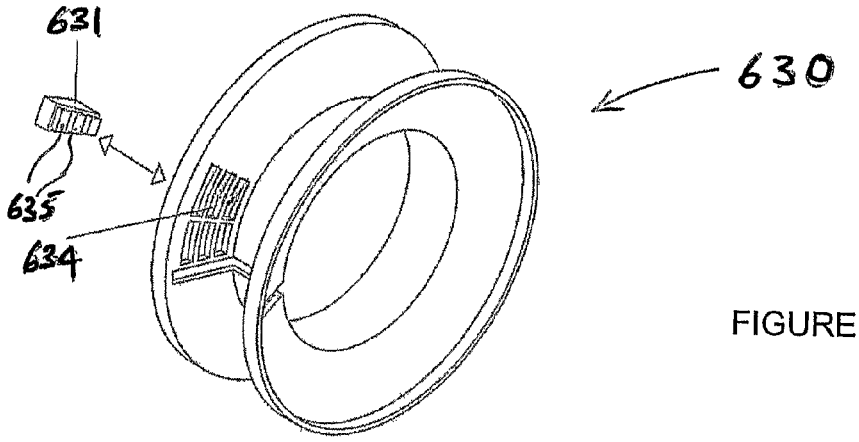
FIG. 11 is another perspective view of the variable port arrangement shown in FIG. 10.

As best seen in FIG. 11 the port 634 is provided by a grill or grating structure in a side wall of the stator which is adapted to receive projections 635 of each plug element 631 and 632. In an alternative embodiment the port 634 may not have a grill structure, for example as single opening.

In an alternative embodiment the plug elements could be hinged at one end (either the radially innermost end or the radially outermost end) to the stator so as to be capable of pivoting towards and away from the port 634 so as to allow them to be opened or closed and thus selectively alter the angular extent of the port.

In a further embodiment multiple port cover elements are hingedly attached to a side wall of the stator whereby hinges are provided at one of the sides (as opposed to the ends) of each port cover element. In yet a further embodiment multiple angularly spaced port cover elements are slidably mounted in a side wall of the stator, such that in use, each element can be slid either substantially radially inwardly towards the rotational axis of the rotor or substantially radially outwardly from the rotational axis.

Figure 12A:
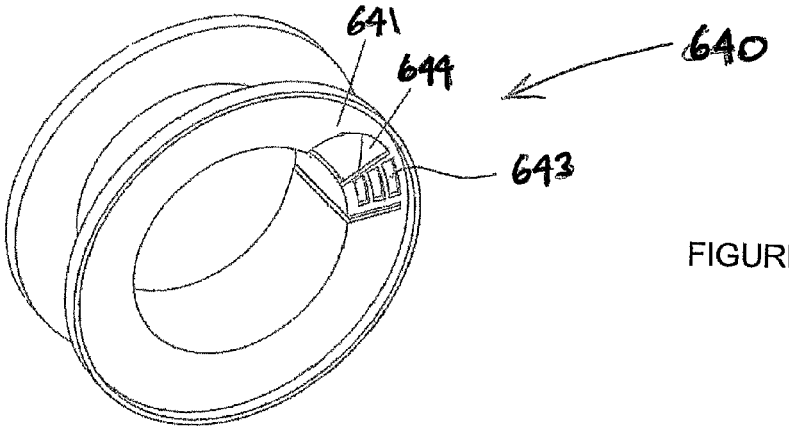
FIG. 12*a* is a perspective view of part of the fourth variable port arrangement in which a pivotally mounted port cover has been removed.
Figure 12:
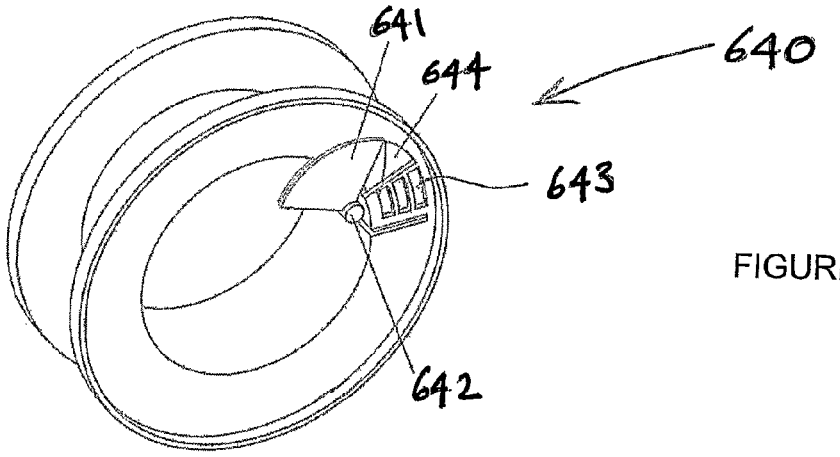
FIG. 12 is a perspective view of a fourth variable port arrangement.

FIG. 12 shows a further variable port arrangement of a stator 640 which comprises a pivotable cover 641 hinged at 642 so as to be able to selectively control the angular extent of port 643 that is provided in the stator side wall. A further port 644 of fixed angular extent is also provided in the stator side wall. The port 643 is best seen in FIG. 12*a* in which the pivotable cover 641 has been omitted. The wall in which the port 643 is formed may be a substantially planar wall.

Figure 13:
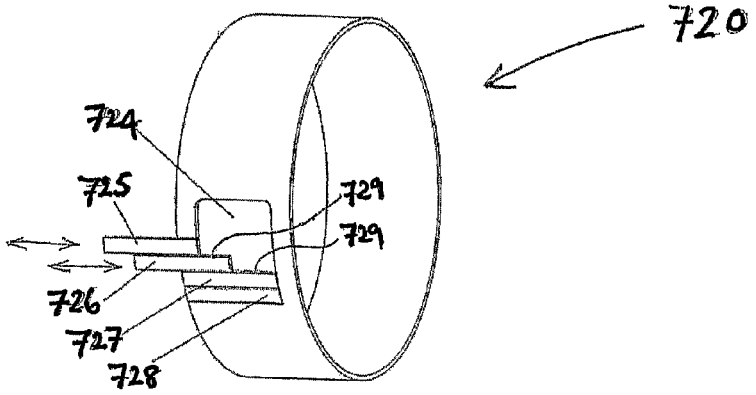
FIG. 13 is a perspective view of a fifth variable port arrangement.

FIG. 13 shows a variable port arrangement 720 provided in the outer housing 24 in which one edge is formed by multiple slidable valve members 725, 726, 727 and 728 which can slide relative to the port 724. In an alternative embodiment the variable port arrangement shown in FIG. 13 may be used to vary the angular extent of a port 9 in a rotor ring 7.

In an alternative embodiment the variable port arrangement shown in FIG. 13 may be provided in a radially innermost base wall 13.

In an alternative embodiment one or more of the valve members 725, 726, 727 and 728 are capable of moving towards and away from the port 724 in a direction generally radial of the annular cylinder space.

In a further alternative embodiment one or more of the valve elements 725, 726, 727 and 728 could be hinged at one end or side, or mounted on another pivot to allow the elements to be opened or closed. In yet a further alternative embodiment one or more of the valve elements 725, 726, 727 and 728 could reciprocate substantially radially with respect to the chamber axis or in another direction to vary the extent of the port.

In a further alternative embodiment the multiple elements 725, 726, 727 and 728 could be joined pivotally to one another so that they can 'unwrap' from the port in the form of a 'chain'. Specifically, adjacent edges 729 of each element are connected by way of a hinge arrangement (not shown). In use, if it is required to increase the size of the opening, then the appropriate number of elements are folded against each other in concertina fashion into a 'stack' whilst the other element/s remain in position to cover part of the port opening. Conversely if it is required to decrease the size of the port opening then the required number of elements is/are 'unwrapped' from the stack to close the opening. Other embodiments are possible in which the elements can be lifted away from the opening rather that folding into a stack.

In an alternative embodiment to those shown in FIGS. 9 and 13, the angular extent of port provided in the rotor ring (eg port 9*a*) could be adapted to be capable of being varied so as to alter the angular extent of the aperture. This could be achieved by providing one or more plug members (not shown) which are adapted to be capable of being removeably inserted into one or more of the openings which form the grill structure of the port of the rotor ring 7.

If both inlet ports and outlet ports of a rotary piston and cylinder device were provided with a variable port arrangement, then the compression ratio (for example), the volume compressed and the volume delivered could be independently controlled by control of one or both of the inlet and outlet ports.

In the case of a rotary piston and cylinder device used as a compressor, the volume compressed could be reduced by increasing the angular extent of the inlet port of the stator. If the angular extent of the outlet port of the outer housing (forming the outlet valve) remained the same the compression ratio would be reduced. If, however, the angular extent of one or both of the outlet ports which together form the outlet valve were reduced, then the compression ratio could be maintained. This would result in a reduction of the volume compressed without a change in the compression ratio or delivery power. This effectively allows the compressor capacity or mass flow to be changed.

In the case of an engine embodiment such a valving strategy could be used to provide an advanced throttling capability. Maintaining the compression ratio while reducing the volume compressed would increase the engine efficiency over simply reducing the compression ratio and volume compressed.

In the case of an engine embodiment a variable inlet port in the outer housing of the expander device could be used in conjunction with a variable outlet port from the compressor device. The variable outlet port from the compressor device would allow the compression ratio to be controlled (independent of the volume compressed), the variable inlet port to the expander device would allow the port timings to be matched as the compressor outlet port was changed.

It will be appreciated that a plurality of one or more different types of any of the variable port arrangements described above could be distributed around the annular cylinder space, for example multiple angularly spaced inlet ports may be provided. Any of the variable port arrangements above may be provided on their own or in conjunction with one or more ports of fixed size. Any of the variable port arrangements described above may be used in combination for the same rotary piston and cylinder device or for an assembly comprising two conjoined devices.

The variable port arrangements described above may be controlled in a variety of ways. For example a variable port arrangement could be controlled by way of manual intervention, either at the time of manufacture and/or as part of a subsequent adjustment or tuning procedure. A variable port arrangement could be controlled by way of suitable actuation means, such as a servo-device, in which a control signal sent to the actuation means adjusts the angular extent of the port. Such actuation means could be arranged to be controlled in real-time during operation of the respective rotary piston and cylinder device in response to control signal from one or more sensors and/or in response to data stored in memory means. The actuation means could be controlled by an engine management system which comprises a data processor and memory means, for example in the form of a firmwave device. Accordingly, operation of the rotary piston and cylinder device could be optimised by way of control of the variable port arrangement in response to varying demands on the device. For example in an engine embodiment such a change could occur as a result of cruising at steady power/speed to accelerating. In a compressor such a change may be constituted by a change in the flow of fluid demanded or the required delivery pressure required. In a supercharger (that may be attached to a conventional engine, for example), such a change in porting may occur to increase the mass flow in response to increased engine power demand.

The invention claimed is:

1. A rotary piston and cylinder device comprising:

an annular cylinder space at least partially defined by a rotor ring comprising at least one piston which extends generally inwardly of the rotor ring, and into the annular cylinder space;

a rotatable cylinder space shutter disc configured to move relative to a stator to a closed position in which the shutter disc partitions the annular cylinder space, and to an open position in which the shutter disc permits passage of the at least one-piston, wherein the stator comprises an aperture region including an aperture that provides fluid communication between the cylinder space and a region external of the device; and an adjustable port arrangement, the adjustable port arrangement comprising a displaceable stator wall portion which is movable relative to the aperture region so as to enable adjustment of at least one of position or an angular extent of the aperture to fix the at least one of said position or said angular extent of the aperture.

2. The rotary piston and cylinder device as claimed in claim 1, in which the aperture region is provided in a side wall of a part of the stator that is positioned generally internally of the rotor.

3. The rotary piston and cylinder device as claimed in claim 2, in which the side wall in which the aperture region is provided is a substantially planar surface.

4. The rotary piston and cylinder device of claim 1, in which the aperture region is provided in a radially innermost wall of a part of the stator that is positioned generally internally of the rotor.

5. The rotary piston and cylinder device as claimed in claim 4, in which the innermost wall in which the aperture is provided is a substantially cylindrical surface.

6. The rotary piston and cylinder device as claimed in claim 1 or claim 2, in which the displaceable stator wall portion is detachably connectable to the aperture region.

7. The rotary piston and cylinder device as claimed in claim 6, in which a plurality of displaceable stator wall portions is provided which is detachably connectable to one or more aperture regions.

8. The rotary piston and cylinder device as claimed in either of claim 1 or claim 2, in which the displaceable stator wall portion is arranged for pivotable movement relative to the aperture region.

9. The rotary piston and cylinder device as claimed in claim 8, in which the pivotable movement of the displaceable stator wall portion is substantially in the same plane as the stator wall.

10. The rotary piston and cylinder device as claimed in either of claim 1 or claim 2, in which the displaceable stator wall portion is arranged for slideable movement relative to the aperture region.

11. The rotary piston and cylinder device as claimed in claim 10, in which the slideable movement of the displaceable stator wall portion is substantially in the same plane as the stator wall.

12. The rotary piston and cylinder device as claimed in claim 1, in which the aperture region forms an inlet port to the device.

13. The rotary piston and cylinder device as claimed in claim 1, comprising a compressor device.

14. The rotary piston and cylinder device as claimed in claim 12, comprising an expander device.

15. The rotary piston and cylinder device as claimed in claim 1, in which the aperture region forms an outlet port to the device.

16. The rotary piston and cylinder device as claimed in claim 15, comprising an expander device.

17. The rotary piston and cylinder device as claimed in claim 15, comprising a compressor device.

18. The rotary piston and cylinder device as claimed in claim 1, wherein the rotor includes an aperture region that communicates with the aperture region in the stator when the two aperture regions are substantially in register, the aperture region in the stator being in a part of the stator that is substantially external to the rotor, the adjustable port arrangement comprising a displaceable stator wall portion that is movable relative to the aperture region so as to adjustably set at least one of a the position or the angular extent of the aperture relative to the annular cylinder space.

19. A rotary piston and cylinder device as claimed in claim 18, in which the displaceable stator wall portion comprises a radially outer housing portion which is mounted for rotational movement about an axis of rotation of the rotor.

20. A rotary piston and cylinder device as claimed in claim 19, which comprises two or more radially outer housing portions which are mounted for movement relative to each other about the axis of rotation of the rotor.

21. A rotary piston and cylinder device as claimed in claim 20, in which the housing portions are adjacent.

22. The rotary piston and cylinder device as claimed in claim 19, in which a wall in which the aperture is provided is a substantially cylindrical surface.

23. The rotary piston and cylinder device as claimed in claim 19, in which the displaceable stator wall portion that is mounted for rotational movement includes the aperture region.

24. A rotary piston and cylinder device comprising:

an annular cylinder space at least partially defined by a rotor ring comprising at least one piston which extends generally inwardly of the rotor ring and into the annular cylinder space;

a rotatable cylinder space shutter disc configured to move relative to a stator to a closed position in which the shutter disc partitions the annular cylinder space, and to an open position in which the shutter disc permits passage of the at least one piston, wherein the stator comprises an aperture region including an aperture that provides fluid communication between the cylinder space and a region external of the device and an adjustable port arrangement, wherein the adjustable port arrangement comprises a displaceable stator wall portion which is detachably connectable relative to the aperture region so as to enable adjustment of at least one of position or an angular extent of the aperture.

25. A rotary piston and cylinder device comprising:

an annular cylinder space at least partially defined by a rotor ring comprising at least one piston which extends generally inwardly of the rotor ring and into the annular cylinder space;

a rotatable cylinder space shutter disc configured to move relative to the stator to a closed position in which the shutter disc partitions the annular cylinder space, and to an open position in which the shutter disc permits passage of the at least one piston, wherein the stator comprises an aperture region including an aperture that provides fluid communication between the cylinder space and a region external of the device and an adjustable port arrangement, the adjustable port arrangement comprising a displaceable stator wall portion which is arranged for pivotable movement relative to the aperture region so as to enable adjustment of at least one of a position or an angular extent of the aperture.

* * * * *

UNITED STATES PATENT AND TRADEMARK OFFICE

CERTIFICATE OF CORRECTION

PATENT NO. : 9,057,268 B2
APPLICATION NO. : 12/279426
DATED : June 16, 2015
INVENTOR(S) : Stephen Francis Lindsey It is certified that error appears in the above-identified patent and that said Letters Patent is hereby corrected as shown below:

In the claims

In Column 16, at line 4, after "claim" delete "1" and insert -- 12 --.

Signed and Sealed this
First Day of March, 2016

Michelle K. Lee

Michelle K. Lee
*Director of the United States Patent and Trademark Office*